US005565839A

United States Patent [19]

Poss

[11] Patent Number: 5,565,839

[45] Date of Patent: Oct. 15, 1996

[54] BATTERY-POWERED, PORTABLE FLASHING SUPERLUMINESCENT LIGHT-EMITTING DIODE SAFETY WARNING LIGHT

[75] Inventor: Glen T. Poss, Spokane, Wash.

[73] Assignee: Grafon Corporartion, Spokane, Wash.

[21] Appl. No.: 393,124

[22] Filed: Feb. 16, 1995

[51] Int. Cl.[6] ..... G08B 5/00

[52] U.S. Cl. ..... 340/331; 362/800; 362/83.3; 362/108; 340/321

[58] Field of Search ..... 362/800, 73, 83.3, 362/157, 108, 103; 340/321, 331

[56] References Cited

U.S. PATENT DOCUMENTS

| | | | |
|---|---|---|---|
| 4,451,871 | 5/1984 | Kirkley et al. | 362/186 |
| 4,849,863 | 7/1989 | Gallegos | 362/108 |
| 5,039,200 | 8/1991 | Michler et al. | 359/517 |
| 5,045,979 | 9/1991 | Stevens | 362/108 |
| 5,175,528 | 12/1992 | Choi et al. | 340/331 |
| 5,313,187 | 5/1994 | Choi et al. | 340/331 |
| 5,313,188 | 5/1994 | Choi et al. | 340/331 |
| 5,388,035 | 2/1995 | Bodem | 362/800 |

*Primary Examiner*—Jeffery Hofsass
*Assistant Examiner*—Daryl C. Pope
*Attorney, Agent, or Firm*—Wells, St. John, Roberts, Gregory & Matkin, P.S.

[57] ABSTRACT

A preferred form of a battery-powered, portable flashing superluminescent light-emitting diode safety warning light 10 is described having a single SLD 40 mounted at a shallow angle of between 3 and 22 degrees on a reflective printed circuit board 54. The SLD 40 has a narrow optical band width that is directed to a thin right angle lens 24 that is mounted in a curved condition between sidewalls 16 and 18. The lens 24 has a smooth outer surface 62 and a grooved inner surface 64. The inner surface 64 has parallel "V" shaped grooves formed therein that form linear prisms 76 that extend in a curved contour between the sidewalls 16 and 18. The light 10 has a battery-powered electrical circuit 50 for pulsing the SLD 40 at a frequency of between 1 and 3 Hz and with a pulse width of between 10 and 50 percent of the frequency period. The electrical circuit 50 utilizes a NPN transistor 98 that is mounted backwards for turning the SLD 40 OFF and ON during the duty cycle. Voltage on a capacitor 106 provides a forward bias on a base-emitter junction of the NPN transistor 98 to turn the transistor 98 ON and discontinues the forward bias to turn the NPN transistor 98 OFF.

15 Claims, 4 Drawing Sheets

BATTERY-POWERED, PORTABLE FLASHING SUPERLUMINESCENT LIGHT-EMITTING DIODE SAFETY WARNING LIGHT

TECHNICAL FIELD

This invention relates to battery-powered, high intensity portable flashing superluminescent light-emitting diode safety warning lights classified in United States Patent Classification System—Class 340, Subclass 331.

BACKGROUND OF THE INVENTION

Bell Sports, Inc. located in California, USA sells battery-powered, high intensity flashing superluminescent light-emitting diode (SLD) safety warning lights under the brand name "VISTA LITE". Each of such safety warning lights use three SLDs. Although such lights are rather effective, they are also rather expensive and consume substantial battery power, requiring that the batteries be replaced more often than would normally be necessary.

Such "VISTA LITE's" are technically described in one or more of the Robert S. Choi et al. U.S. Pat. Nos. 5,175,528, 5,313,187, and 5,313,188.

One of the principal objects and advantages of the present invention is to provide a battery-powered, high intensity flashing SLD safety warning light that is very effective even when using only one SLD.

A further object and advantage of the present invention is to provide a battery-powered, high intensity flashing SLD safety warning light that is considerably less expensive to manufacture, thus offering the public better economic value.

An additional object and advantage of the present invention is to provide a battery-powered, high intensity flashing SLD safety warning light that consumes less battery power during operation, thus requiring that the batteries be replaced less frequently.

These and other objects and advantages of the present invention will become apparent upon carefully studying the following detailed description of a preferred embodiment along with the accompanying claims.

BRIEF DESCRIPTION OF THE DRAWINGS

Preferred embodiments of the invention are described below with reference to the accompanying drawings, which are briefly described below.

FIG. 7 is an electrical schematic view of an electrical circuit for driving and controlling the SLD.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
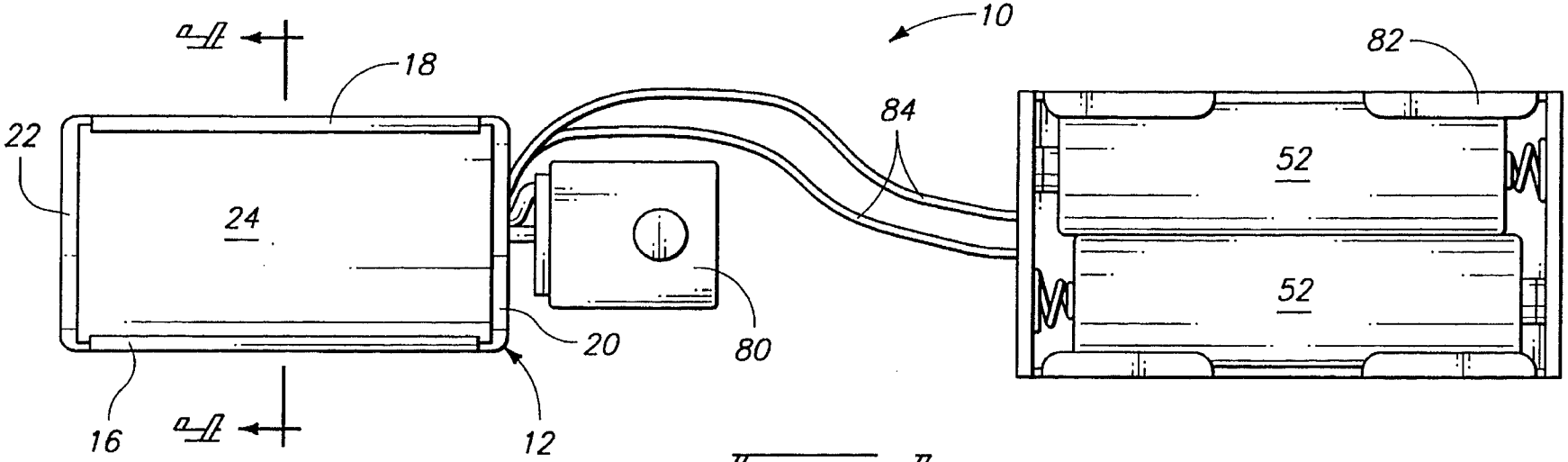
FIG. 1 is a top view of a preferred embodiment of the battery-powered, high intensity flashing SLD safety warning light.
Figure 2:
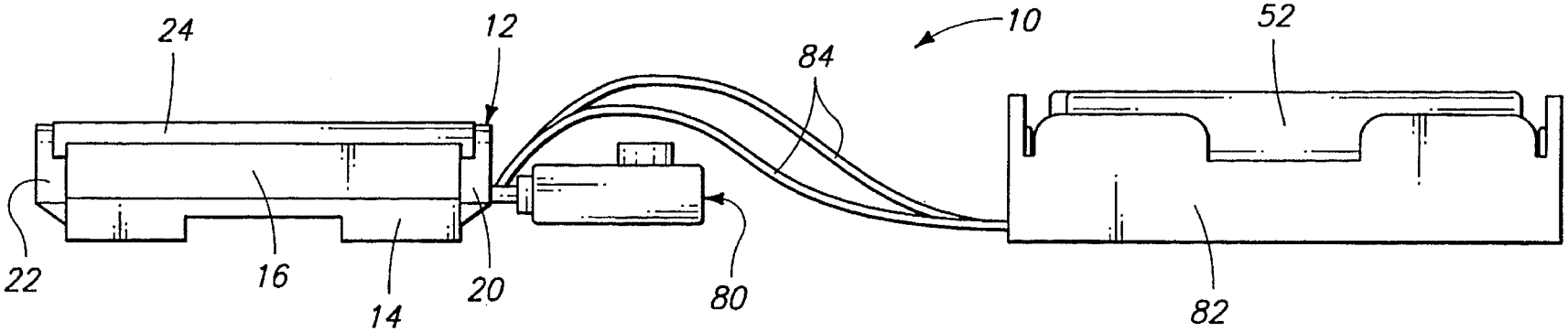
FIG. 2 is side view of the safety warning light illustrated in FIG. 1.
Figure 3:
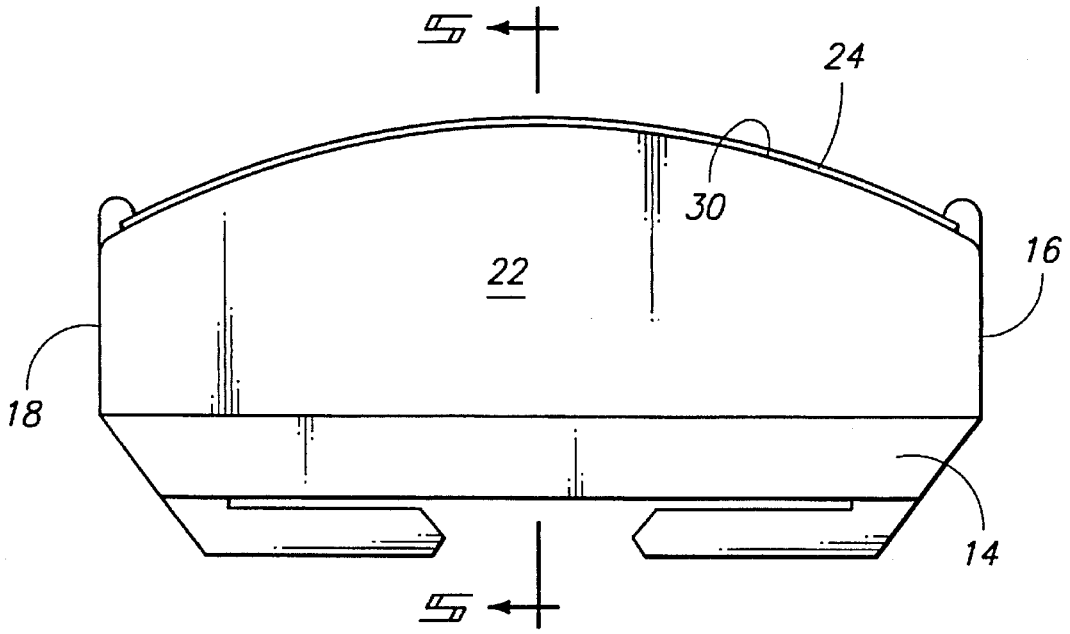
FIG. 3 is an end view of the safety warning light illustrated in FIG. 1.

There is illustrated in FIGS. 1 and 2 a preferred embodiment of a battery-powered, high intensity portable flashing superluminescent light-emitting diode safety warning light, generally designated with the numeral 10. The safety warning light 10 is designed to generate a flashing low frequency high intensity directional light signal of between 1 and 3 Hz having a pulse width of between 10% and 50% of the frequency period.

The light 10 includes a light housing 12 having a base or back wall 14, sidewalls 16 and 18 and end walls 20 and 22. The housing 12 has a front or face opening receiving a curved thin face lens 24. The end wall 20 has a curved groove 28 formed in a top edge 26 for receiving and supporting an edge of the face lens 24 in a curved contour. The end wall 22 has a similar curved groove 32 formed in a top edge 30 for receiving and supporting an opposite edge of the face lens 24 in the curved contour. The sidewalls 16 and 18 have opposing grooves 34 for each receiving side edges of the face lens. The sidewalls 16 and 18 have retaining shoulders 36 adjacent the grooves 34 to retain and hold the face lens 24 in the curved contour defined by the curved contours of the grooves 28 and 32. It should be noted that in the preferred embodiment the lens is curved outward about an axis of curvature that extends between the end walls 20 and 22.

The safety warning light 10 importantly includes a light source in the form of a superluminescent light-emitted diode (SLD) 40. Such diodes are technically described in the U.S. Patents mentioned in the "Background of Invention" section of this application. Such SLD 40 has a base 42 and a shroud 44. Preferably, the SLD 40 generates a narrow light band width signal about the optical axis 46 of between five and fifteen degrees, which is represented by the angle "A" illustrated in FIG. 5. Most preferably the band width angle "A" is approximately eight degrees.

The safety warning light 10 includes an electrical circuit, generally designated with the numeral 50 that is connected to a portable battery 52 for activating and pulsing the SLD 40 to generate the high intensity flashing light signals. The electrical circuit 50 includes a printed circuit board 54 that is securely mounted in the housing 12 against the back wall 14 facing the lens 24. The printed circuit board 54 has a large area reflective surface 58 for reflecting light rays to the lens 24. The SLD 40 is supported on the printed circuit board 54 by a bracket 56. The bracket 56 supports the SLD 40 at a shallow inclined angle or angle of incident "B" to both the printed circuit board surface 58 and the lens 24 relative to the optical axis 46 of the SLD 40. Preferably the angle of incident "B" is between three and twenty-two degrees, and most preferably between five and fifteen degrees.

The face lens 24 has a thin transparent body 60 with a generally rectangular shape with a preset length between end edges 70 and 72 and a preset width between side edges 66 and 68. The body 60 preferably has a thickness of between 0.02 and 0.03 inches and most preferably a thickness of approximately 0.022 inches. The end edges 70, 72 are supported in respective curved end grooves 28 and 32, respectively. The side edges 66 and 68 are supported in side grooves 34 and held in place by retaining shoulders 36.

The thin face lens has a smooth outer surface 62 and a grooved inner surface 64. "V" shaped linear grooves 74 (FIGS. 5 and 6) are formed in the inner surface 64, forming "right angle" linear prisms 76. Preferably, each groove 74 has an acute angle of approximately 71 degrees and the prisms 76 are spaced at a pitch of 0.10 inches. The thin face lens 24 is made of a clear plastic material such as polycarbonate or acrylic. The lens 24 is cut from a flat sheet of the material, and is then bent into the desired curvature dictated by the contour of the receiving grooves 28 and 32. Because of the grooved inner surface 64, the flexibility of the lens 24 is significantly greater in the direction normal to the prisms 76 than the flexibility in the direction that is parallel with the prisms 76. In the preferred embodiment, the lens 24 is rather uniformly curved between the side edges 66 and 68 about an axis of curvature that is normal to the direction of the prisms 76. Stated in a different way, the parallel prisms 76 extend between the side edges 66 and 68. The SLD 40 is positioned with the optical axis intersecting the lens normal to the direction of the prisms 76.

Figure 4:
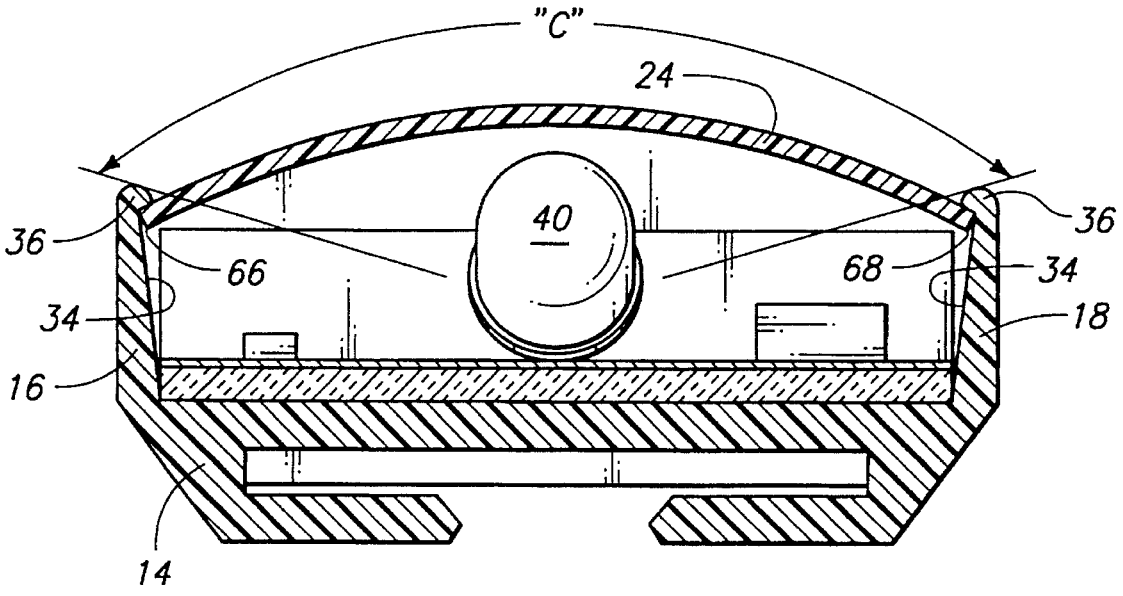
FIG. 4 is vertical cross-sectional view taken along line 4—4 in FIG. 1, illustrating an SLD mounted on a printed circuit board and directed upward to a curved special thin lens for transmitting a flashing light at a wide angle perpendicular to the curvature of the special lens.
Figures 5, 6:
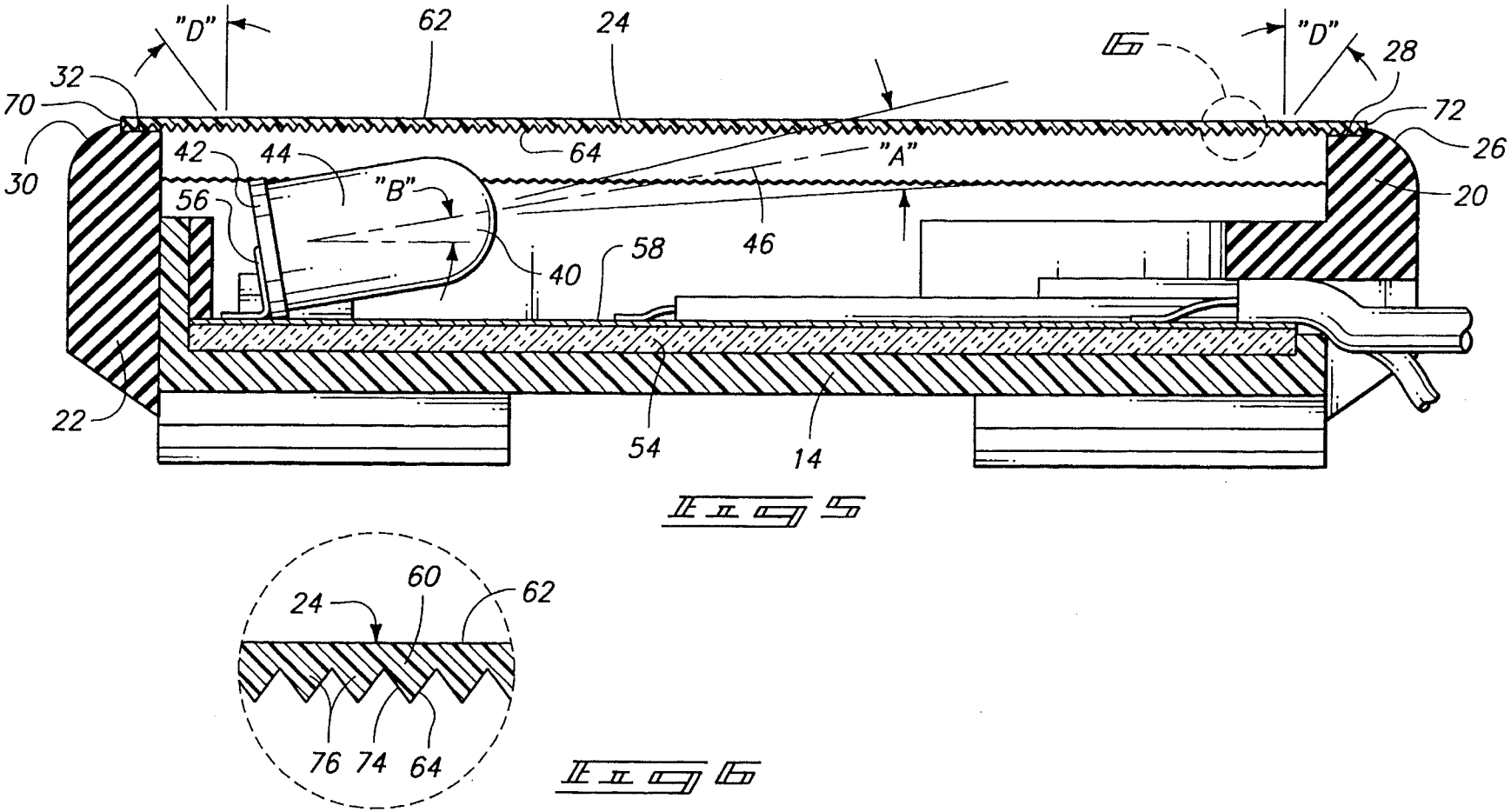
FIG. 5 is a vertical cross-sectional view taken along line 5—5 in FIG. 3 illustrating the angular relationship between the printed circuit board, the SLD and the special lens parallel with the curvature of the special lens.
FIG. 6 is an isolated fragmentary view of a portion of the special lens illustrating linear prism elements on an inside surface.
Figure 11:
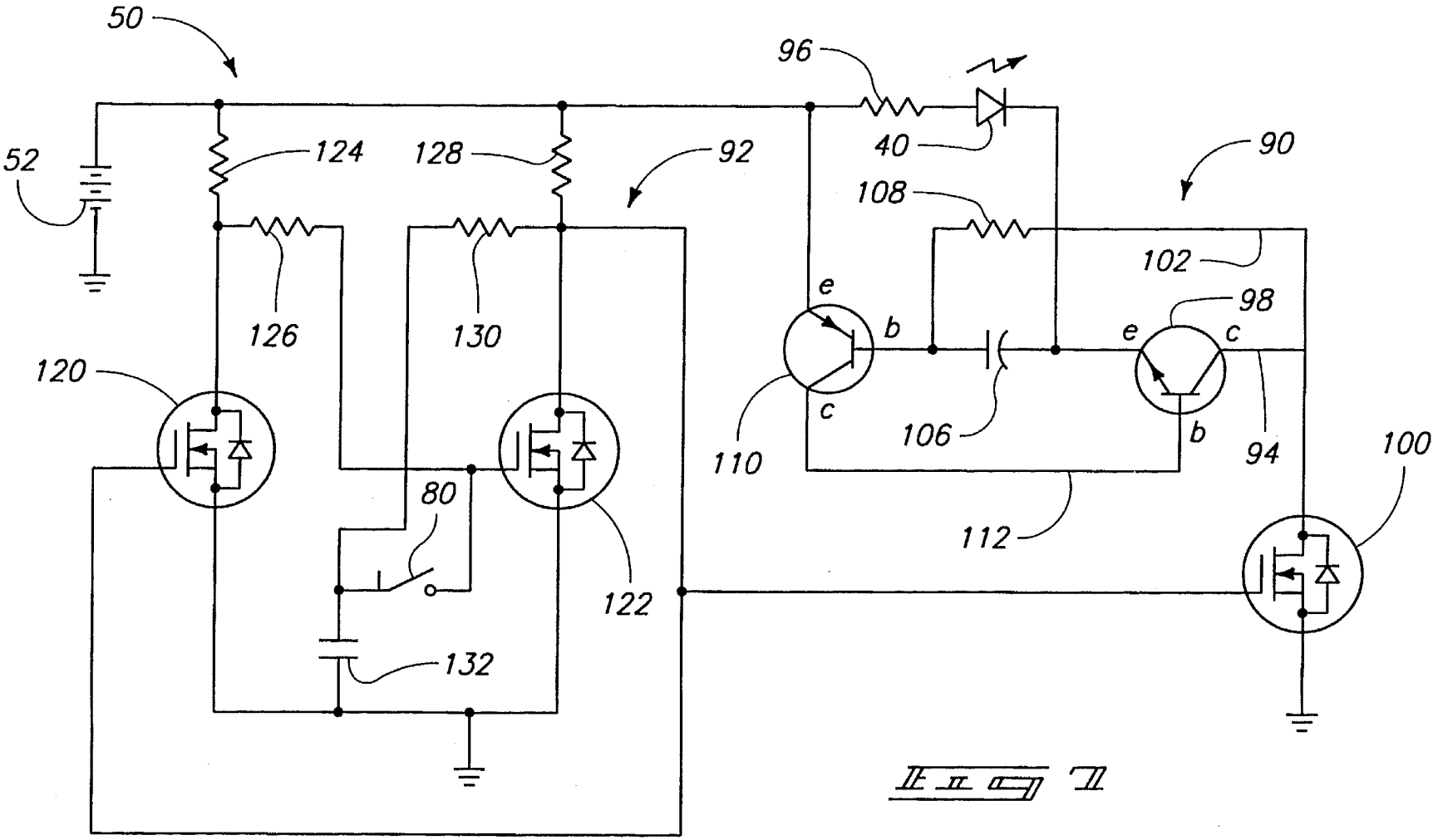

In operation, it has been found that the prisms 76 serve as light tubes or optical fibers for transmitting the high intensity radiation from the SLD transverse along the length of the prisms 76, providing the light 10 with a wide optical aperture in the curved direction as exemplified by the aperture angle "C" shown in FIG. 4. It has additionally been found that high intensity radiation exits along the full length of the lens 24 even though only a single SLD 40 is utilized. The light rays exiting along the length of the lens exit at substantially right angles to the outer surface 62. Angle "D" is varies been normal to 20 degrees from normal, as illustrated in FIG. 5.

The self-supporting, transparent, flat thin lens material used in constructing the lens 24 is commercially available from the 3M Company under the descriptive title "transmissive right angle film", commonly referred to as "TRAF".

The electrical circuit 50 includes a pulsing circuit 90 and a manually activated switch circuit 92. The pulsing circuit 90 includes a conductive path 94 that extends from the battery 52 to ground. A resistance matching resistor 96, the SLD 40, a low impedance NPN transistor 98 and a MOSFET switch 100 are mounted in series in the path 94. The value of the matching resistor 96 is chosen depending upon the characteristics of the type and configuration of the battery 52. It should be noted that the NPN transistor 98 is mounted in reverse to its normal application, with the emitter terminal connected to the output terminal of the SLD 40 and the collector terminal connected to the MOSFET switch 100. The NPN transistor 98 serves as a low impedance switch when it is ON or saturated to draw current from the battery 52 through the SLD 40 to ground to illuminate the SLD, assuming the MOSFET switch 100 is also turned ON. It should be noted that the current flows in reverse through the NPN transistor 98 from the emitter to the collector when the transistor 98 is turned ON. Such a reverse orientation of the transistor 98 enables the transistor 98 to turn the current flow OFF and ON very rapidly, while presenting a low impedance when ON and a very high impedance when OFF to prevent current leakage from the battery during the OFF portion of the pulsing duty cycle. The base voltage to the base of NPN transistor 98 is controlled by a base control PNP transistor 110 in a conductive path 112 in which the emitter terminal of the transistor 110 is connected to the battery and the collector terminal is connected to the base of NPN transistor 98. One of the purposes of the transistor 110 is to maintain the base voltage applied to the transistor 98 above a minimum high value to forward bias the base-emitter junction of transistor 98 to the ON condition to conduct current in reverse at a low impedance from the emitter to the collector through transistor 98.

The pulsing circuit 90 has a conductive path 102 parallel to the NPN transistor 98. A charging-discharging capacitor 106 and a timing resistor 108 are mounted in series in the parallel path 102. The capacitor 106 is charged while the transistor 98 is ON, rather than being charged while the transistor 98 is OFF. Importantly, as the capacitor 106 is being charged, the voltage progressively increases at the emitter terminal of the transistor 98. When the charging voltage exceeds a certain value relative to the base voltage applied to the base terminal of transistor 98, the forward bias of the base-emitter junction terminates and the NPN transistor automatically turns OFF, dropping the current flow through the SLD 40 below its threshold to terminate illumination. During the OFF portion of the duty cycle, the capacitor 106 discharges through the timing resistor 108 to ground. It should be noted that during the OFF portion of the duty cycle, current is not being drained from the battery 52, which materially adds to the life of the battery. Consequently the SLD 40 is not being driven by the discharge of capacitor 106. The capacitor 106 is charging during the ON portion of the cycle and is discharging during the OFF portion of the cycle. The voltage of the capacitor 106 is used to turn the SLD 40 driving current OFF and ON.

When the voltage on the discharging capacitor 106 falls below an emitter-base threshold of the transistor 98, it automatically turns ON to start the duty cycle again. The light pulse width portion (ON portion) of the duty cycle or frequency period is determined in large part by the time required to charge the capacitor 106 to the termination of the forward bias of the emitter-base junction of transistor 98. The OFF light pulse width (OFF portion) of the duty cycle or frequency period is determined in large part by the time required to discharge the capacitor 106 to an emitter-base voltage threshold necessary to forward bias the transistor 98 back ON. The values of the capacitor 106 and the resistor 108 are important in controlling such discharge or transistor 98 OFF time. The base of the PNP transistor 110 is connected to the path 102 between the capacitor 106 and the resistor 108 to provide a current buffer.

Preferably, the component values of the pulsing circuit are chosen so that the SLD 40 generates a high intensity light pulse or signal at a frequency of between 1 and 3 Hz. It is further desirable to select the value of the components to provide a light pulse width that is between ten and fifty percent of the frequency period.

The manually activated switch circuit 92 includes the manual switch 80 which is illustrated schematically in FIG. 7. The circuit 92 is principally a stable flip-flop circuit using cross-linked MOSFETs 120 and 122 for controlling the MOSFET 100. Resistors 124 and 126 serve as pull-up resistors to maintain the MOSFET 120 turned ON, and resistors 128 and 130 serve as pull-up resistors to maintain the MOSFET 122 turned ON. When the switch 80 is pushed OFF, capacitor 132 is discharged to ground and MOSFET 122 is turned ON to turn MOSFET 100 OFF to render the pulsing circuit 90 inactive. When the switch 80 is pushed closed, the capacitor 132 to charged to turn MOSFET 122 OFF and MOSFET 120 ON. This in turn turns MOSFET 100 ON to activate the pulsing circuit 90.

With this explanation, it can be appreciated that this invention provides a rather inexpensive pulsing light that provides a very high intensity broad band light signal using a minimum of components.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A battery-powered, portable high intensity flashing superluminescent light-emitting diode safety warning light, comprising:

a housing;

a curved thin face lens mounted to the housing having a substantially smooth curved outer lens surface and a grooved curved inner lens surface with linear prism elements extending perpendicular to the curvature of the lens;

a light source composed of a superluminescent light-emitting diode (SLD) mounted in the housing for directing high intensity visible light toward the curved lens at a preselected shallow incident angle, said light source having its optical axis perpendicular to said linear prism elements; and a battery-powered electrical circuit operatively connected to the SLD for pulsing the SLD at a preset frequency and preset duration to generate high intensity visible pulsing light signals through the lens.

2. The safety warning light as defined in claim 1 where the SLD is mounted at a shallow incident angle of between 3 and 22 degrees to the thin curved lens.

3. The safety warning light as defined in claim 1 wherein the lens is initially formed in a flat condition and then bent into a curved condition and wherein the housing has retention means for retaining the thin lens in the curved condition.

4. The safety warning light as defined in claim 1 wherein the SLD has a narrow light beam width of between 5 and 10 degrees.

5. The safety warning light as defined in claim 4 where the SLD is mounted at a shallow incident angle of between 3 and 22 degrees to the thin curved lens.

6. The safety warning light as defined in claim 1 wherein the thin lens is formed of self-supporting transmissive right angle film.

7. The safety warning light as defined in claim 6 wherein thickness of the lens is between 0.02 and 0.03 inches.

8. The safety warning light as defined in claim 1 wherein the thin lens is differentially more flexible in a direction normal to the linear prisms and less flexible in a direction parallel with the linear prisms.

9. The safety warning light as defined in claim 1 wherein the thin film has a peripheral edge and wherein the housing has means for supporting the thin film along the peripheral edge in the curved condition.

10. The safety warning light as defined in claim 1 further comprising a printed circuit board mounted in the housing substantially parallel with the axis of curvature of the lens and wherein the SLD is mounted on the printed circuit board.

11. A battery-powered, portable high intensity flashing superluminescent light-emitting diode safety warning light, comprising:

a housing;

a lens mounted to the housing;

a light source composed of a superluminescent light-emitting diode (SLD) mounted in the housing for directing high intensity visible light toward the lens at a preselected incident angle; and a battery-powered electrical circuit operatively connected to the SLD for pulsing the SLD at a preset frequency and preset duration to generate high intensity visible pulsing light signals through the lens;

wherein the electrical circuit includes an SLD pulsing circuit having a NPN transistor in a path between the SLD and ground in which an emitter terminal is connected to the SLD and a collector terminal is operatively connected to ground to provide a low impedance path to ground when the NPN transistor is turned ON to draw battery current through the SLD to activate the SLD.

12. The portable safety warning light as defined in claim 11 wherein the NPN transistor is turned ON when a base-emitter junction is forward biased.

13. The portable safety warning light as defined in claim 11 wherein a charging capacitor and discharge resistor are mounted in series in a path parallel to the path containing the NPN transistor to cause the capacitor to charge while the SLD is activated and to terminate forward biasing of the base-emitter junction of the NPN transistor to turn the NPN transistor OFF as the capacitor is being charged to discontinue drawing current through the SLD and thereby turn the SLD OFF.

14. The portable safety warning light as defined in claim 11 wherein the electrical circuit includes a manual switch activation circuit that includes a manually operated switch that is operatively connected to a MOSFET in the pulsing circuit that is mounted between the NPN transistor collector and ground that serves as a power switch in the pulsing circuit to permit conduction when the manual switch is turned ON and to prevent conduction when the manual switch is turned OFF.

15. The portable safety warning light as defined in claim 13 wherein values of the capacitor and resistor primarily determining the pulsing frequency of the pulsing circuit and wherein the values are selected to generate a pulsing frequency of between 1 and 3 Hz.

* * * * *